United States Patent [19]

van Gils

[11] 4,077,899

[45] Mar. 7, 1978

[54] GETTERING DEVICE OF MANUFACTURING A COLOR TELEVISION DISPLAY TUBE WHILE USING SAID GETTERING DEVICE, AND COLOR TELEVISION DISPLAY TUBE THUS MANUFACTURED

[75] Inventor: Wilhelmus Adrianus van Gils, Eindhoven, Netherlands

[73] Assignee: U.S. Philips Corporation, New York, N.Y.

[21] Appl. No.: 725,783

[22] Filed: Sep. 23, 1976

[30] Foreign Application Priority Data

Sep. 30, 1975 Netherlands ..... 7511482

[51] Int. Cl.[2] ..... H01J 7/18; H01J 35/20

[52] U.S. Cl. ..... 252/181.4; 252/181.7

[58] Field of Search ..... 252/181.4, 181.7

[56] References Cited

U.S. PATENT DOCUMENTS 3,579,459 5/1971 Della Porta et al. ..... 252/181.4

FOREIGN PATENT DOCUMENTS 1,226,728 3/1971 United Kingdom ..... 252/181.4

898,505 6/1962 United Kingdom ..... 252/181.4

OTHER PUBLICATIONS

Hausner, H.; Handbook of Powder Metallurgy, 1973, p. 2.

*Primary Examiner*—Brooks H. Hunt

*Attorney, Agent, or Firm*—Frank R. Trifari

[57] ABSTRACT

The chemical resistance of a gettering device comprising a mixture of barium-aluminium powder and nickel powder compressed in a metal holder is considerably increased by using nickel powder having a specific surface smaller than 0.15 $m^2$ per gram and an average grain size smaller than 80 microns, while the barium aluminium powder has an average grain size smaller than 125 microns. The said gettering device is extremely suitable for use in the manufacture of a color display tube in which the gettering device is to be placed inside the envelope of the tube before certain parts of said envelope are sealed together at a high temperature.

4 Claims, 4 Drawing Figures

Figure 1:
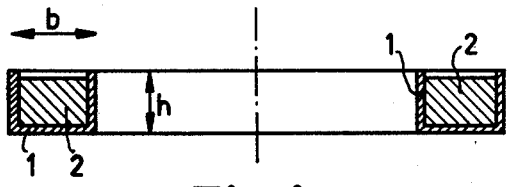

GETTERING DEVICE OF MANUFACTURING A COLOR TELEVISION DISPLAY TUBE WHILE USING SAID GETTERING DEVICE, AND COLOR TELEVISION DISPLAY TUBE THUS MANUFACTURED

The invention relates to a gettering device comprising a metal getter holder containing a compressed powder mixture of nickel and a barium-aluminium alloy, from which mixture barium as the gettering metal can be evaporated by heating. The invention also relates to a method of manufacturing a colour television display tube while using such a gettering device, and to a colour television display tube manufactured by such a method.

Such a gettering device is known and has been used in particular in the manufacture of cathode ray tubes, for example television display tubes. After evacuating the tube, the residual gases remaining therein are gettered by a layer of gettering metal applied on the inside of the tube wall. This layer of gettering metal is deposited on the inside of the tube wall by heating the gettering device to such a high temperature, usually by inductive heating, that an exothermic reaction sets in between the nickel and the barium-aluminium alloy, the nickel binding the aluminium, the barium evaporating. The evaporated barium deposits as a thin layer of gettering metal on a part of the inside surface of the tube wall and maintains its gettering action during the life of the tube.

A number of conditions must be satisfied both for the manufacture of the gettering device and the usefulness of the gettering device in an electron tube. For the mass production of gettering devices in an automated production process, it is necessary for the components of the pulverulent mixture with which the getter holder of the device is filled to be miscible homogeneously. Furthermore the mixture must have good rheological properties so that the getter holders can be filled in a reproducible manner. It must be possible to evaporate a reproducible quantity of barium from the manufactured gettering device, while the residue should remain in the holder in a readily adhering manner. The usefulness of the gettering device is furthermore determined to a considerable extent by the extent to which the mixture is chemically inert in air. The chemical composition of the mixture should not change under the conditions prevailing during the storage of the gettering devices or during the manufacture of the tubes in which they are used. An example in which the gettering device is exposed to an atmosphere which is particularly unfavourable in this respect is disclosed in United Kingdom patent specification No. 1,226,728. This specification relates to a method of manufacturing a colour television display tube in which necessarily the gettering device is mounted in the tube prior to the display window being sealed to the cone of the tube by means of a glass enamel. The connection of said envelope parts takes place in a furnace at a temperature of approximately 450° C and lasts approximately one hour. In such circumstances the nickel of the known gettering devices is converted at least partly into nickel oxide. This nickel oxide upon heating the gettering device reacts so violently with the barium aluminium alloy that particles of solid are ejected from the compressed powder mixture in the getter holder. Such particles may cause spots on the display screen or produce a short-circuit between electrodes of the electron gun. The measures known so far to solve said problem have been restricted to the provision of a protective layer or foil over the free surface of the compressed powder mixture in the holder. It has also been suggested to replace the nickel powder by a nickel in a chemically more resistant form, for example, a nickel-titanium compound. Although said measures result indeed in a gettering device in which the powder mixture is less affected by atmospheric influences, a lower yield of barium is obtained as compared with a gettering device in which said measures have not been taken, which in certain cases may be undesirable.

Experiments have proved that the properties of the powder mixture, both with respect to the manufacture of the gettering device and with respect to the usefulness thereof in an electron tube, can be improved considerably when the grain size distribution of the components of the powder mixture and in particular the specific surface of the nickel powder satisfies certain requirements.

According to the invention, a gettering device comprising a powder mixture of nickel and a barium-aluminium alloy compressed in a metal holder from which barium as the gettering metal can be evaporated by heating, is characterized in that the mixture consists for 40 – 60% by weight of nickel powder, said nickel powder having a specific surface smaller than $0.15m^2$ per gram and an average grain size smaller than 80 microns, the barium-aluminium powder having an average grain size smaller than 125 microns.

Grain size is to be understood to mean herein the maximum dimension of a grain and average grain size is to be understood to mean the total of these maximum dimensions divided by the number of the grains. With a given grain size the extent to which the grains, as regards shape, differ from the true spherical shape is determined by the specific area of the grains. Furthermore the specific area is decisive of the quantity of oxygen which is taken up during a firing treatment by the nickel-powder.

A particularly favourable composition of the mixture is obtained with nickel powder which shows a grain size distribution having an average grain size between 30 and 60 microns. In a composition of the mixture which is particularly favourable also with respect to the remaining properties of the gettering device, the nickel powder has the following grain size distribution:

| | | | | |
|---|---|---|---|---|
| 0 | percent by weight | smaller than | 15 | microns |
| 0.1 – 0.2 | " | " | 20 | " |
| 3 – 10 | " | " | 30 | " |
| 22 – 60 | " | " | 40 | " |
| 70 – 96 | " | " | 50 | " |
| 86 – 99 | " | " | 55 | " |
| 97 – 100 | " | " | 65 | " |

By a correct choice of the grain size distribution of the nickel powder the quantity of oxygen taken up by the gettering device during the sealing of the cone and the window of the tube can be restricted in such a manner that the usefulness of the gettering device is maintained. With respect to said usefulness, the grain size of the barium-aluminium powder in combination with that of the nickel powder furthermore plays an important part. These grain sizes should be matched to each other in such a manner that the components can be mixed homogeneously and a good contact area is obtained between the barium-aluminium alloy grains and the nickel grains.

Favourable results are obtained, if, according to the invention, 80 to 90% by weight of the barium-aluminium powder has a grain size smaller than 100 microns.

A gettering device according to the invention can be exposed without objection for at least one hour to a moist atmosphere of approximately 450° C. Such a gettering device is hence extremely suitable for use in a manufacturing process of a colour television display tube in which the gettering device is mounted in the tube before the glass cone of the tube is sealed to the display window. The properties of the powder mixture as regards the homogeneous miscibility of the components, the rheology and the barium yield upon evaporation are so favourable that the use of the gettering device in its totality presents advantages with respect to the known gettering devices in which barium-aluminium powder having an average grain size between 150 and 300 microns and nickel powder having a specific surface larger than 0.15 $m^2$ per gram are usual. As regards the anchoring of the residue to the holder of the gettering device, extra precautions may be taken, if desired, in the form of a perforated flat metal ring which is spotwelded to the bottom of the holder.

Figure 2:
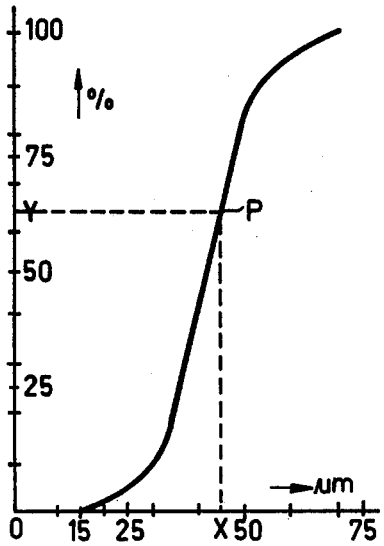
Figure 3:
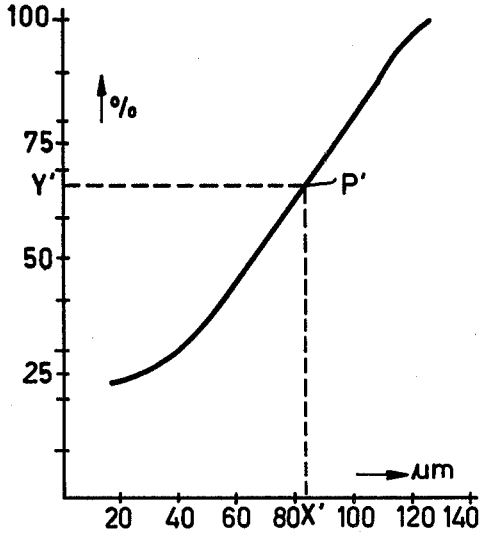
Figure 4:
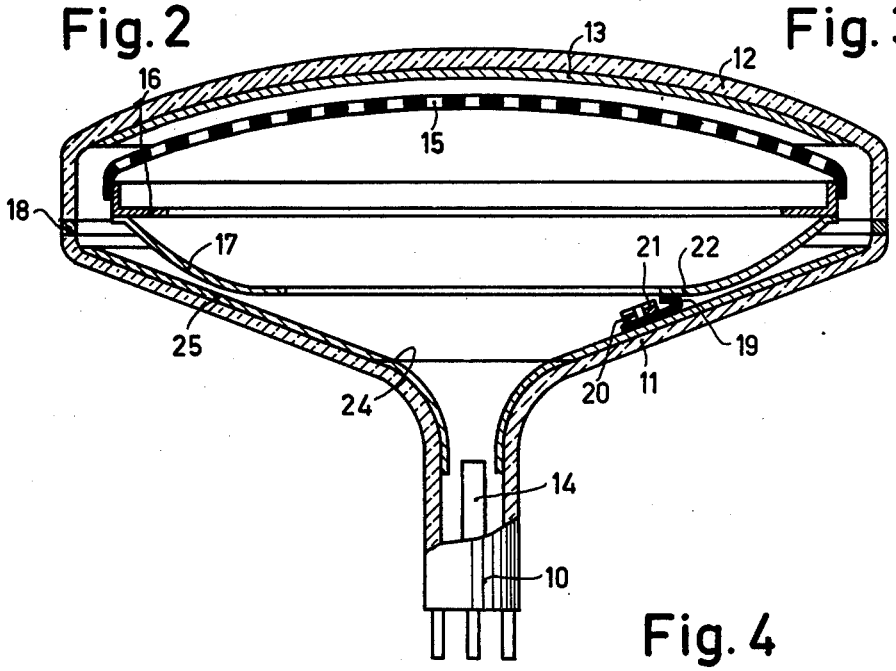

The invention will be described in greater detail with reference to the drawing, in which:

FIG. 1 is an axial sectional view of a gettering device according to the invention having an annular holder, FIGS. 2 and 3 show grain size distributions of nickel powder and barium-aluminium powder, respectively, satisfying the object underlying the invention, and FIG. 4 is an axial sectional view of a colour television display tube manufactured while using the gettering device shown in FIG. 1.

The holder shown in FIG. 1 consists of a chromium-nickel steel gutter 1 the depth *h* of which is 2 mm and the width *b* is 5 mm. The holder is manufactured from sheet material having a thickness of 0.25 mm. A powdered mixture of 1 part by weight of barium-aluminium ($BaAl_4$) and 1 part by weight of nickel is compressed in the gutter. It is also possible to compress the mixture as a pre-shaped body in the holder. The grain size of the nickel powder satisfies the distribution as is shown in FIG. 2, while that of the barium-aluminium powder satisfies the distribution shown in FIG. 3. In these Figures, the grain size in microns is plotted on the horizontal axis. With a given grain size, that fraction can be read on the vertical axis in percent by weight which contains grains smaller than the relevant grain size. For example, for the point P on the curve shown in FIG. 2 it holds that Y % by weight of the nickel powder consists of grains the grain size of which is smaller than X microns. Analogously, it applies for point P′ in the curve shown in FIG. 3 that Y′% by weight of barium-aluminium powder consists of grains the grain size of which is smaller than X′ microns.

The display tube for colour television shown in FIG. 4 has a neck 10, a cone 11 and a glass window 12. On the inside of the window a layer 13 of areas fluorescing in red, green and blue is provided which in known manner constitutes a line pattern or a dot pattern. The tube furthermore comprises a metal shadow mask 15 and a metal magnetic screening cap 17, which are secured to a metal supporting frame 16. A gettering device 21 according to the invention and comprising a metal annular holder 20 has been welded to the end of a metal strip 19. The other end of the metal strip 19 has been welded to the screening cap 17 at 22. With the gettering device thus mounted, the window 12 is secured to the cone 11 by means of a glass enamel 18. For that purpose, the assembly had been exposed to a temperature of 450° in a furnace for one hour. The diagrammatically shown gun system 14 with which three electron beams can be generated, has then been placed in the neck of the tube and the tube has been evacuated. The exothermic reaction between the barium-aluminium ($BaAl_4$) and the nickel has finally been initiated by an inductive heating of the gettering device, the barium being liberated from the device and being deposited as a thin layer of a gettering metal on surfaces present inside the space formed by the mask 15 and the screening cap 17. The location of the gettering device is such that the part of a resistant layer 25 provided on the inner surface of the tube present between the line denoted by 24 and the gun system 14 is not covered by barium. As a matter of fact, the object of such a resistance layer is to minimize the detrimental result of a possible high voltage breakdown in the tube for certain components in the control circuit connected thereto. With a usual connection of the gettering device to the gun system, or to an element connected to said gun system, said resistance layer is short-circuited again by the deposited barium, which is avoided in the case of the above-described location of the gettering device.

What is claimed is:

1. A gettering device comprising a powder mixture of nickel and a barium-aluminium alloy, compressed in a metal holder from which barium as the gettering metal can be evaporated by heating, said mixture comprising 40 to 60% by weight of nickel powder, said nickel powder having a specific surface smaller than 0.15 $m^2$ per gram and an average grain size smaller than 80 microns, the barium-aluminium powder having an average grain size smaller than 125 microns, and wherein the specific surface area of said metal powder increases as the grain size decreases.

2. A gettering device as claimed in claim 1 characterized in that the nickel powder shows a grain size distribution having an average grain size between 30 to 60 microns.

3. A gettering device as claimed in claim 1 or 2, characterized in that the nickel powder has the following grain size distribution:

| | | | | |
|---|---|---|---|---|
| 0 | percent by weight | smaller than | 15 | microns |
| 0.1 – 0.2 | " | " | 20 | " |
| 3 – 10 | " | " | 30 | " |
| 22 – 60 | " | " | 40 | " |
| 70 – 96 | " | " | 50 | " |
| 86 – 99 | " | " | 55 | " |
| 97 – 100 | " | " | 65 | " |

4. A gettering device as claimed in any preceding claim, characterized in that 80 – 90% by weight of the barium-aluminium powder has a grain size smaller than 100 microns.

* * * * *

UNITED STATES PATENT OFFICE

CERTIFICATE OF CORRECTION

Patent No. 4,077,899 Dated March 7, 1978

Inventor(s) WILHELMUS ADRIANUS VAN GILS

It is certified that error appears in the above-identified patent and that said Letters Patent are hereby corrected as shown below:

Col. 4, (Claim 2) line 46, "to" should be --and--

Signed and Sealed this

*Eighth* Day of *August 1978*

[SEAL]

*Attest:*

RUTH C. MASON
*Attesting Officer*

DONALD W. BANNER
*Commissioner of Patents and Trademarks*